US012628919B2

(12) United States Patent
Kopanski

(10) Patent No.: US 12,628,919 B2
(45) Date of Patent: May 19, 2026

(54) MOLDED FASTENER ELEMENTS WITH LATERAL WINGS

(71) Applicant: Velcro IP Holdings LLC, Manchester, NH (US)

(72) Inventor: Gregory K. Kopanski, Candia, NH (US)

(73) Assignee: Velcro IP Holdings LLC, Manchester, NH (US)

( * ) Notice: Subject to any disclaimer, the term of this patent is extended or adjusted under 35 U.S.C. 154(b) by 223 days.

(21) Appl. No.: 18/523,990

(22) Filed: Nov. 30, 2023

(65) Prior Publication Data

US 2024/0188690 A1 Jun. 13, 2024

Related U.S. Application Data

(60) Provisional application No. 63/431,132, filed on Dec. 8, 2022.

(51) Int. Cl.
*A44B 18/00* (2006.01)

(52) U.S. Cl.
CPC ..... *A44B 18/0053* (2013.01)

(58) Field of Classification Search
CPC ..... A44B 18/0053; A44B 18/0049; A44B 18/0065; B29C 2043/465; B29C 43/222; B29C 43/46; B29L 2031/729
See application file for complete search history.

(56) References Cited

U.S. PATENT DOCUMENTS

| | | | | |
|---|---|---|---|---|
| 5,857,245 | A | 1/1999 | Sakakibara et al. | |
| 7,493,676 | B2 | 2/2009 | Murasaki et al. | |
| 8,225,467 | B2 | 7/2012 | Gallant et al. | |
| 9,888,746 | B2 | 2/2018 | Murasaki et al. | |
| 10,864,662 | B2 | 12/2020 | Armela et al. | |
| 11,051,590 | B2 | 7/2021 | Abe et al. | |
| 2002/0124359 | A1* | 9/2002 | Murasaki | B29C 43/222 24/452 |
| 2003/0074771 | A1* | 4/2003 | Duffy | A44B 18/0049 24/442 |
| 2004/0134045 | A1* | 7/2004 | Poulakis | A44B 18/0049 24/442 |

(Continued)

OTHER PUBLICATIONS

International Preliminary Report on Patentability in International Appln. No. PCT/US2023/081742, mailed on Jun. 19, 2025, 9 pages.

(Continued)

*Primary Examiner* — David M Upchurch
(74) *Attorney, Agent, or Firm* — Fish & Richardson P.C.

(57) ABSTRACT

A fastener in the form of a flexible strip with a layer of resin having opposite longitudinal edges, and an array of discrete fastening elements carried on a surface of the flexible strip. Each fastening element has a resin stem extending upward from, and contiguous with, the layer of resin, the stem having opposite lateral side surfaces facing the edges of the flexible strip, and a wing protruding from one of the lateral side surfaces of the stem and spaced above the layer of resin. The wing defines an area in a vertical plane coincident with one of the side surfaces of the stem. As measured perpendicular to the layer of resin, the centroid of the area is closer to the lowermost point of the area than to the uppermost point of the area.

13 Claims, 7 Drawing Sheets

(56) References Cited

U.S. PATENT DOCUMENTS

| | | | | |
|---|---|---|---|---|
| 2005/0217087 | A1 | 10/2005 | Gallant | |
| 2008/0018025 | A1* | 1/2008 | Duffy | A44B 18/0073 264/503 |
| 2009/0010735 | A1 | 1/2009 | Gallant et al. | |
| 2013/0133176 | A1* | 5/2013 | Takehara | A44B 18/0015 24/442 |
| 2016/0374829 | A1 | 12/2016 | Vogt et al. | |
| 2017/0008435 | A1* | 1/2017 | Murasaki | B60N 2/7017 |
| 2019/0008239 | A1* | 1/2019 | Fukuhara | A44B 18/0007 |
| 2019/0053582 | A1 | 2/2019 | Gallant et al. | |
| 2019/0239599 | A1 | 8/2019 | Terada et al. | |
| 2020/0121034 | A1 | 4/2020 | Ren et al. | |
| 2020/0305558 | A1* | 10/2020 | Takekawa | A44B 18/0049 |
| 2020/0390199 | A1* | 12/2020 | Michihata | A44B 18/0049 |
| 2021/0060830 | A1 | 3/2021 | Armela et al. | |

OTHER PUBLICATIONS

International Search Report and Written Opinion in International Appln. No. PCT/US2023/081742, mailed on Apr. 9, 2024, 14 pages.

* cited by examiner

MOLDED FASTENER ELEMENTS WITH LATERAL WINGS

CROSS REFERENCE TO RELATED APPLICATIONS

This application claim priority to U.S. Provisional Application No. 63/431,132, filed Dec. 8, 2022, which is hereby incorporated by reference in its entirety for all purposes.

TECHNICAL FIELD

This invention relates to molded fastener elements, and methods of engaging such fastener elements in self-engaging fastener arrays.

BACKGROUND

Some fastener products have an array of discrete projecting fastener elements that interlock with fastener elements of a related product to form a releasable fastening. This type of fastener is sometimes referred to as 'self-engaging,' particularly when the fastener elements of each product are of a similar size and shape.

Fastener elements of self-engaging fastener (SEF) products are generally designed with overhanging heads that deflect as the two arrays are pressed into engagement, and that once engaged require head deflection to separate. Many SEF products employ mushroom-type fastener elements, having heads that overhang in multiple directions. Many such mushroom-type fastener elements are made by deforming the ends of molded or extruded stems to create heads that overhang on multiple sides of the stem. It is possible to make SEF arrays using only molded hooks that each overhang in a single direction, as is taught in U.S. Pat. No. 8,225,467.

With many SEF products, it can be desirable to have some sort of feedback, such as aural or haptic, indicating that the two arrays are fully engaged.

Improvements in fastener elements useful for SEF products, and fastener element structures also useful for releasable engagement with loops, are desired.

SUMMARY

One aspect of the invention features a fastener having a flexible strip with a layer of resin and having opposite edges extending longitudinally along the flexible strip, and an array of discrete fastening elements carried on a surface of the flexible strip. Each fastening element includes a resin stem extending upward from, and contiguous with, the layer of resin, the stem having opposite lateral side surfaces facing the edges of the flexible strip, and a wing protruding from one of the lateral side surfaces of the stem and spaced above the layer of resin. The wing has an underside surface facing and overhanging the layer of resin, and an upper surface facing away from the layer of resin. The wing defines an area in a vertical plane coincident with one of the side surfaces of the stem, the area having a lowermost point and an uppermost point with respect to perpendicular distance from the layer of resin, the area defining a centroid.

In some embodiments, the centroid is closer to the lowermost point than to the uppermost point, as measured perpendicular to the layer of resin.

In some examples the upper surface forms a pair of projections spaced apart along the lateral side surface of the stem and extending away from the flexible strip, the upper surface defining a recess between the projections. The projections may, for example, be disposed at opposite ends of the wing.

In some embodiments, in all vertical planes parallel to the side surface of the stem and extending through the wing, a cross-section of the wing has a centroid closer to a lowermost point of the cross-section than to an uppermost point of the cross-section.

In some cases the wing extends laterally from the stem to a free distal edge.

In some examples the underside surface of the wing is not reentrant.

In some cases, the upper surface of the wing is U-shaped.

The wing preferably has a thickness, measured perpendicular to the surface of the layer of resin, that is less at a point between opposite ends of the wing than at the opposite ends of the wing.

In some examples the wing defines, adjacent the vertical plane, a greater statical moment of area with respect to bending downward about a first bending axis extending parallel to the layer of resin in the vertical plane at a lowermost extent of the wing, than with respect to bending upward about a second bending axis extending parallel to the layer of resin in the vertical plane at an uppermost extent of the wing.

In some embodiments, the array of discrete fastening elements is configured and arranged to form a releasable fastening when inter-engaged with an identical array of fastening elements. Such embodiments are referred to as 'self-engaging'. Preferably, the array of discrete fastening elements is configured and arranged to cause each fastener element of a column disposed between fastener element columns of the identical array to overlap wings of at least three fastener elements of the identical array.

Another aspect of the invention features a method of releasably joining two surfaces. The method includes bringing two fasteners as described above into contact with each other such that the wings of one of the fasteners are in contact with the wings of the other of the fasteners, with each of the two fasteners carried on respective ones of the two surfaces, and pressing the two fasteners together such that the wings deflect to interlock, leaving the wings of the one of the two fasteners closer to the layer of resin of the other of the two fasteners than the wings of the other of the two fasteners.

Yet another aspect of the invention features a method of molding a fastener product. The method includes pressing flowable resin into a mold defining an array of closed fastener element cavities extending inward from a surface of the mold, solidifying the pressed resin in the cavities along with a layer of resin formed on the surface of the mold, and stripping the solidified resin from the cavities by tension applied to the layer. Notably, each cavity is shaped to form a resin stem extending upward from, and contiguous with, the layer of resin, the stem having opposite lateral side surfaces facing the edges of the flexible strip, and a wing protruding from one of the lateral side surfaces of the stem and spaced from the layer of resin. The wing has an underside surface facing and overhanging the layer of resin, and an upper surface facing away from the layer of resin. The wing defines an area in a vertical plane coincident with one of the side surfaces of the stem, the area having a lowermost point and an uppermost point with respect to perpendicular distance from the layer of resin, the area defining a centroid. The centroid, as measured perpendicular to the layer of resin, is closer to the lowermost point than to the uppermost point.

Configuring laterally-extending wings to have area centroids in the lower half of the wing cross-section has been found to provide a tangible benefit in the relative engagement and disengagement force profiles of fastener element arrays, as well as enhancing haptic engagement feedback. During engagement, the upper portion of the wing sees significant tension and elongates as the wing flexes to engage, whereas during disengagement, the lower portion of the wing sees tension as the wing flexes to release. Benefits may also be obtained by designing the wing to have a greater statical moment of area with respect to bending downward about a horizontal bending axis along the lateral side surface of the stem at a lowermost extent of the wing, as compared to the statical moment of area with respect to bending upward about a horizontal bending axis along the lateral side surface of the stem at an uppermost extent of the wing. Various structures disclosed herein may also provide advantage in the releasable engagement of loop fibers, particularly those structures with longitudinally offset wings.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
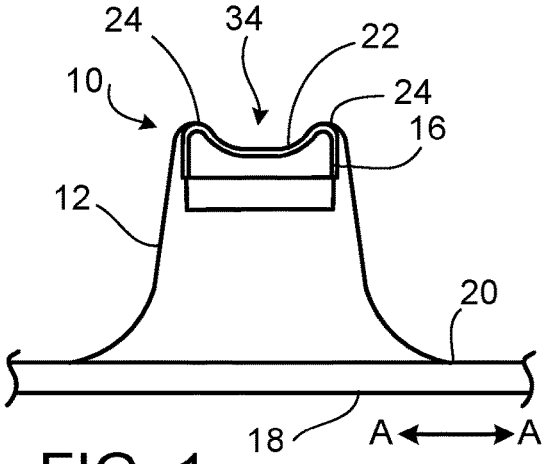
FIG. 1 is a side view of a fastener element.
Figure 2:
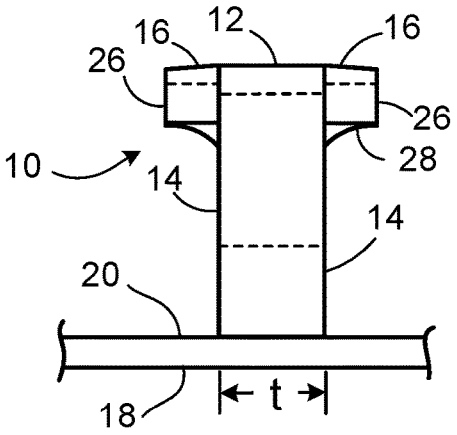
FIG. 2 is an end view of the fastener element of FIG. 1.
Figure 3:
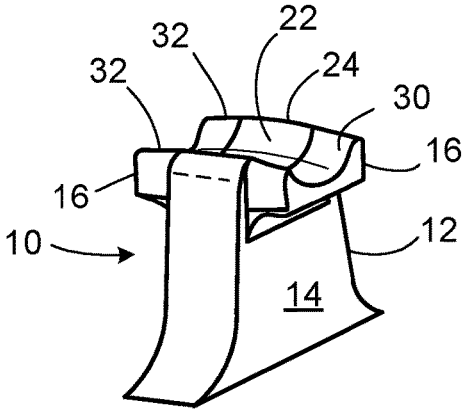
FIG. 3 is a perspective view of the fastener element of FIG. 1

Referring first to FIGS. 1-3, a male fastener element 10 has a central stem 12 with flat, opposite sides 14 and a curved profile. From each of the opposite sides 14 a respective wing 16 extends, spaced above a flexible strip 18, at least the top of which is formed by a layer 20 of resin with which the stem 12 forms a single, contiguous mass of resin. The flat, opposite sides 14 lie in vertical planes extending perpendicular to layer 20 and define a generally constant thickness 't' of the stem. In this particular example, the upper surface 22 of the stem is concave, forming a recess at the top of the stem that extends between the opposite sides 14 between two rounded peaks 24 that in this example form the highest extent of the male fastener element 10 above the strip 18. The strip itself is longitudinally continuous along direction A-A in FIG. 1, such that opposite sides 14 will be referred to as opposite lateral side surfaces.

Each wing 16 extends laterally to a flat distal end 26 that lies in a vertical plane. The wings and stem together are also a single, contiguous mass of resin, formed by molding the entire structure in a cavity of similar shape as will be described below. The shape of each wing is such that it extends generally laterally, with top and side surfaces only slightly tapered (e.g., at 4.5 degrees) to facilitate removal of the molded wing from its portion of the mold cavity. The underside surface 28 of each wing faces and overhangs the layer 20 of resin, with a significant radius where the underside surface 28 meets the lateral side surface 14 of the stem. The upper surface 30 of each wing faces away from the layer of resin. The upper surface of each wing forms a pair of projections 32 spaced apart along the lateral side surface 14 of the stem and extending away from the flexible strip 18, the upper surface defining a recess 34 between the projections. The upper end of each projection 32 is curved, with a radius of about 0.05 mm, and the recess 34 defines an arc with a radius of about 0.12 mm. Each fastener element 10 is symmetrical about a vertical plane extending through the stem midway between the two wings.

To give a sense of the general size of such fastener elements, the overall height of the stem is about 0.93 mm and the stem thickness is 0.35 mm. The wings have an overall length, along A-A, of 0.6 mm, and an overall height (excluding the underside radius) of about 0.22 mm, and extend a total of 0.2 mm from the stem.

Figure 4:
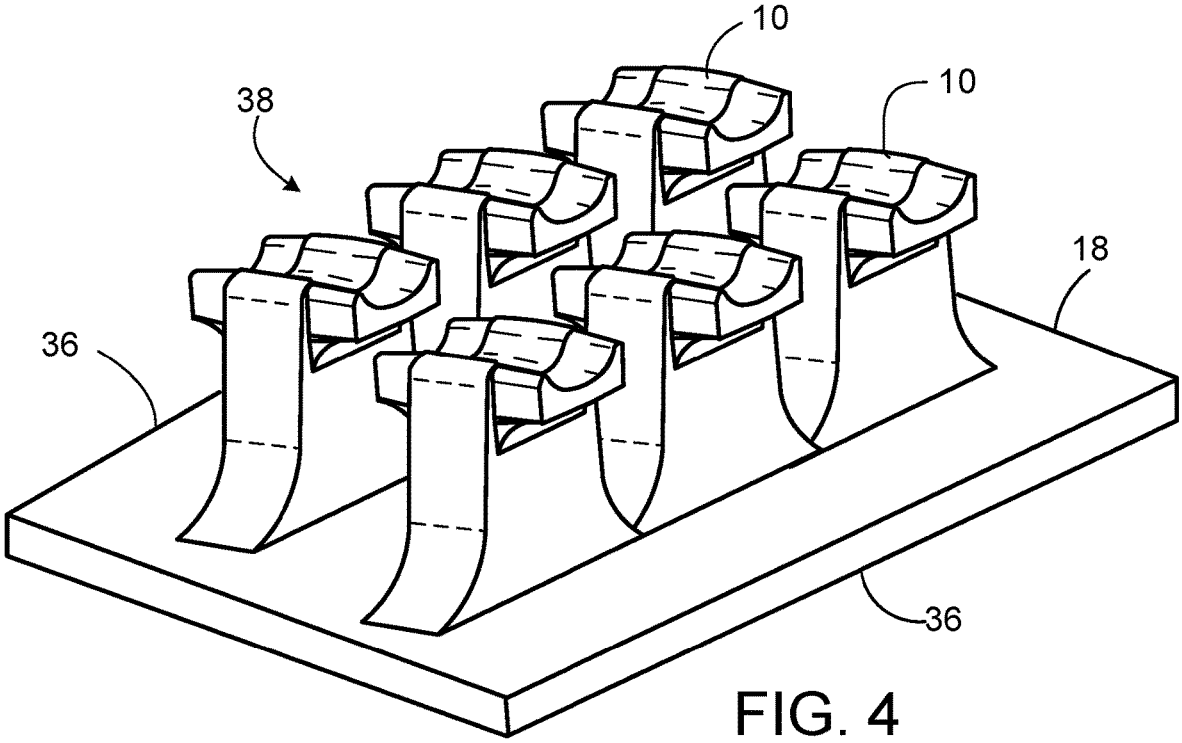
FIG. 4 is an illustration of a portion of an array of fastener elements as in FIG. 1, as part of a fastener strip.

Referring to FIG. 4, in a typical array many such male fastener elements will be arranged in rows and columns along the flexible strip 18, with their lateral opposite side surfaces 14 facing the longitudinal edges 36 of the strip. FIG. 4 is illustrated with only two columns and three rows of fastener elements 10, but in most commercial applications a strip will have 10 or more columns and 50 or more rows of such elements. As shown, the fastener elements of adjacent columns may be offset slightly in the longitudinal direction, such that fastener elements of a given row are not in precise alignment.

Figure 5:
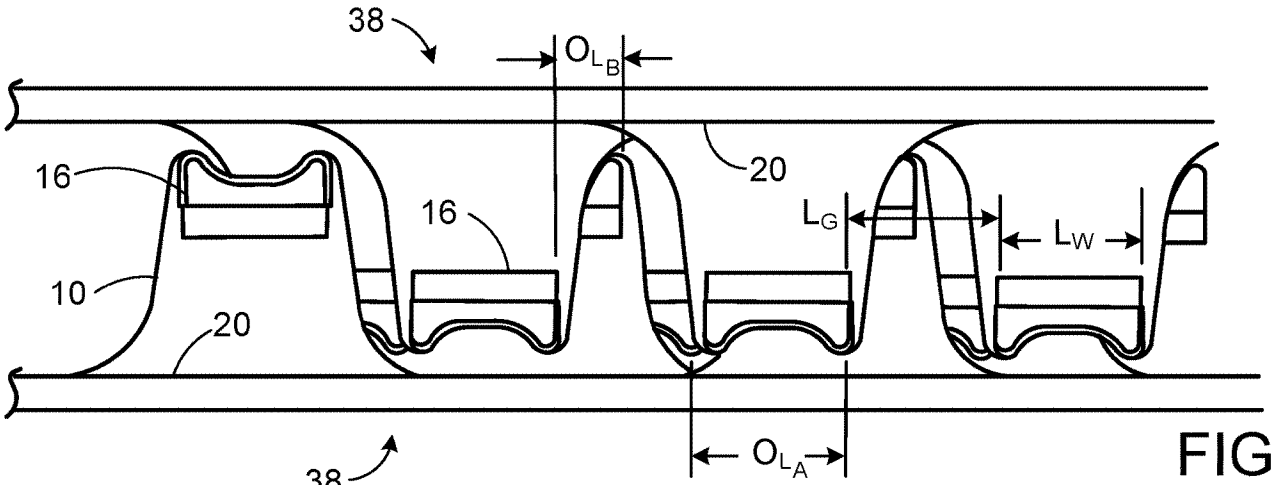
FIG. 5 is a side view of two of the fastener strips of FIG. 4 in an engaged state.

The offset is also visible in FIG. 5, which shows two of the fastener strips 38 of FIG. 4 inter-engaged, with their arrays of fastener elements 10 facing each other and overlapping, such that the wings 16 of the fastener elements of one fastener strip 38 are closer to the layer 20 of resin of the other fastener strip 38 than are its own wings 16. The amount of longitudinal offset $O_{LA}$ between the adjacent columns of one fastener strip is slightly more than the overall length $L_W$ of one of the wings in the longitudinal direction, which is slightly more than the overall length $L_G$ of the gap between wings in the longitudinal direction ($L_W > L_G$). Adjacent fastener elements of the two inter-engaged arrays are also longitudinally offset by a distance $O_{LB}$ that is less than the length of one of the wings. Once engaged, the arrays of fastener elements will be able to slide past one another in the direction transverse to the wings. This machine-direction sliding is useful in the winding of mated fastener strips about a roll. Ideally the wings of adjacent structures in any given columns will be spaced such that the opposing wings of the mating fastener strips will always overlap as the two arrays are slid along one another. It will be understood that the elevation variation across the top of the wing (in this case, the projections extending above the central recess) can help to can provide some resistance to sliding when two unmated fastener strips are held against each other such that the top surfaces of the wings are in contact. Molding these structures in cavities, rather than as an extrusion that is later cut and stretched, means that irregularities in the fastener element pattern can be intentionally designed into the array to produce haptic feedback during sliding.

The fastener strips 38 illustrated here are principally designed for such inter-engagement, also referred to as self-engagement, rather than engagement with a field of loops, although such a fastener strip could indeed form a releasable fastening with a suitable loop material.

Figure 5A:
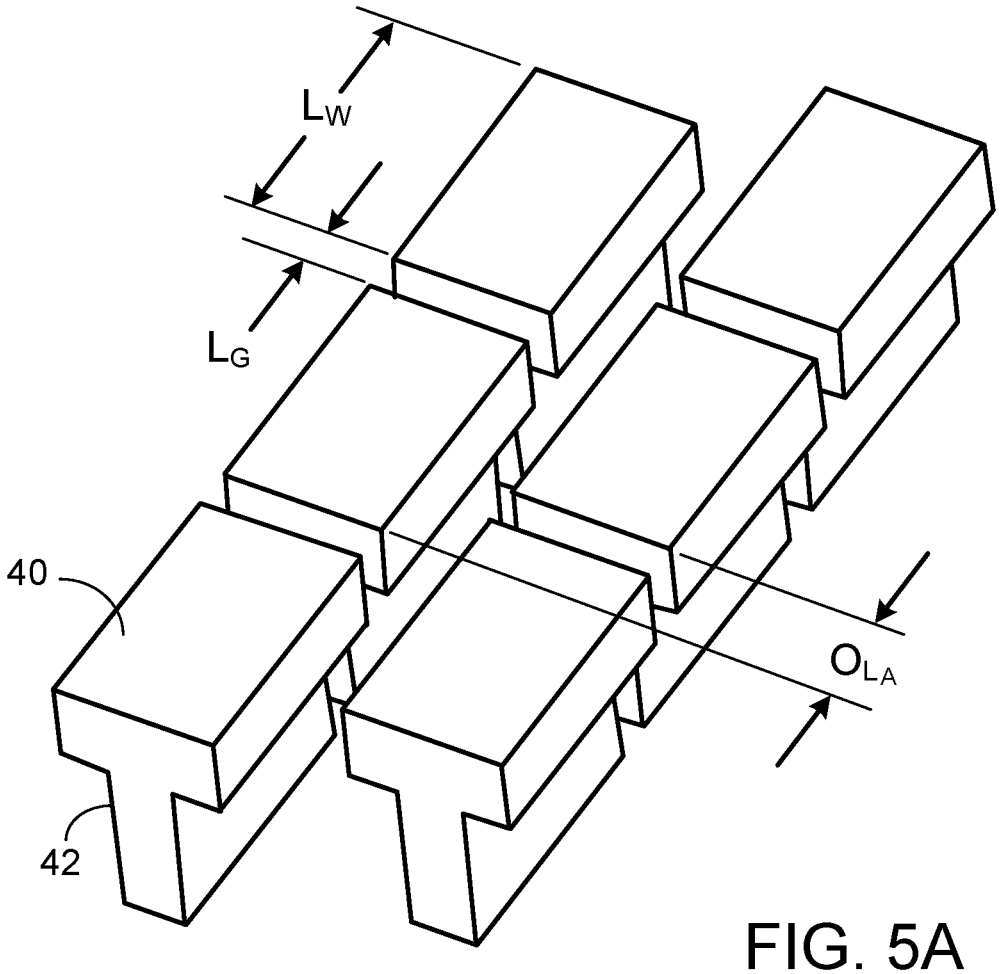
FIG. 5A schematically illustrates two parallel, adjacent columns of winged fastener elements.

FIG. 5A schematically represents two adjacent columns of an array of such winged fastener elements, with the projected top area of the wings and stem of each element represented by a block 40 atop a post 42. To ensure that each winged fastener element will always engage at least three fastener elements of the mating array, two relationships must be true. First, the wing length $L_W$ must be greater than the sum of the longitudinal offset $O_{LA}$ and the gap length $L_G$. In other words, $L_W>(O_{LA}+L_G)$. Second, the gap length $L_G$ must be less than one-half the longitudinal offset $O_{LA}$, or $L_G<O_{LA}/2$.

Figure 6:
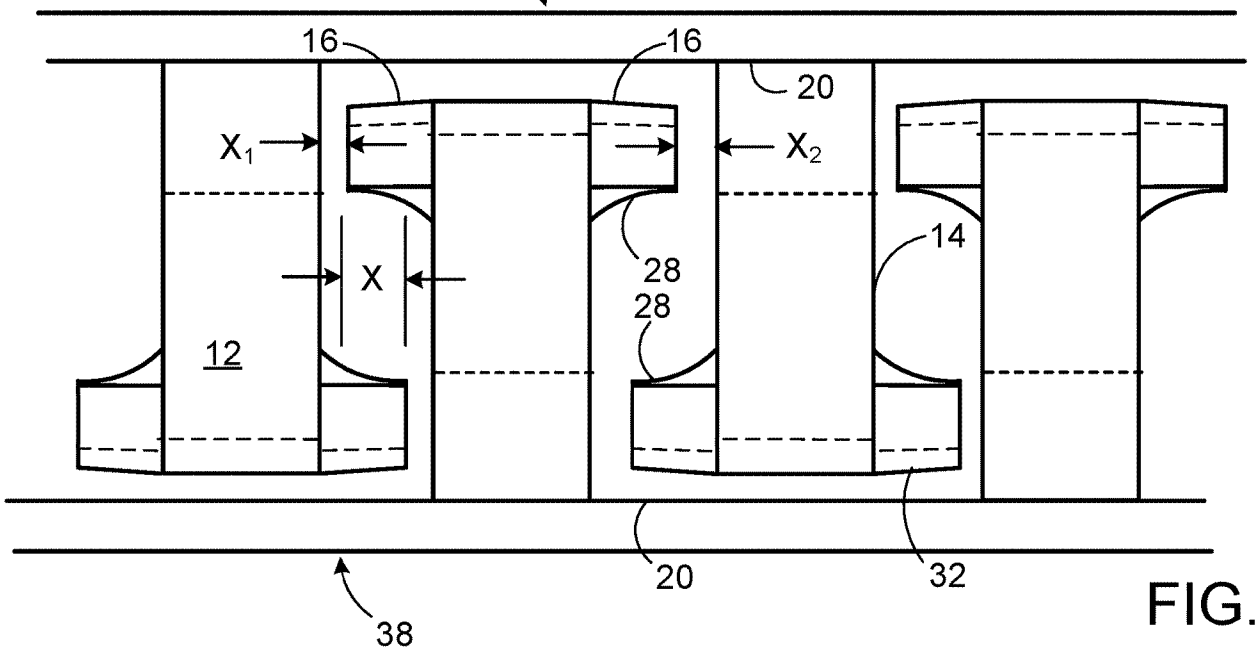
FIG. 6 is an end view of the two engaged fastener strips of FIG. 5.

FIG. 6 shows the inter-engagement of the two arrays. The wings 16 of the two fastener strips 38 overlap in a lateral direction by a distance 'x', meaning that the inter-engaged arrays of fastener elements 10 will resist separation by interference between the wings as the two strips are pulled away from each other. Overlap distance 'x' is greater than the total later clearance between adjacent columns (i.e., x>(X1+X2)), which, combined with the longitudinal interference of the wings ($L_W>L_G$), means that the two arrays cannot be separated from any relative position without at least some wing deflection.

Figure 7A:
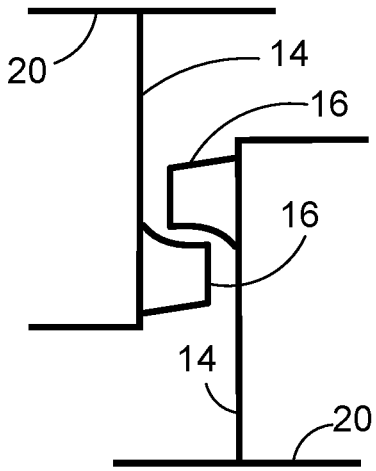
FIGS. 7A-7D sequentially illustrate disengagement of fastener strips by elastic deflection of the fastener element wings.
Figure 7B:
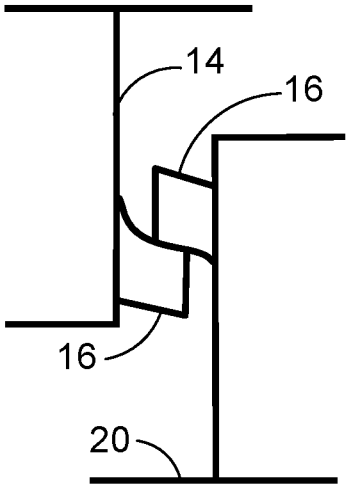
Figure 7C:
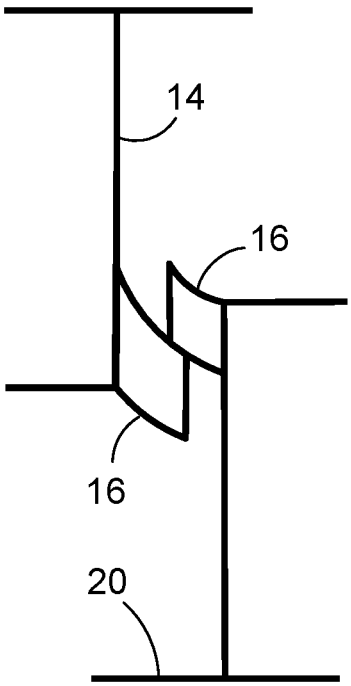
Figure 7D:
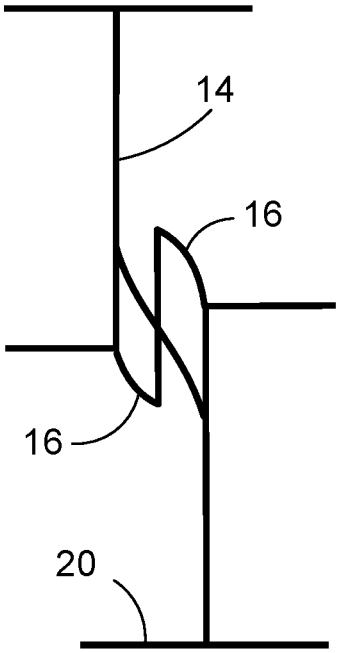

FIGS. 7A-7D sequentially illustrate wing deflection during such a separation. Only one set of interfering wings are shown, for purposes of illustration, and the deflections are not intended to be to scale. As the inter-engaged strips begin to separate, their respective wings approach one another (FIG. 7A) until their underside surfaces touch. Further separation causes the touching wings to bend away from their respective layers 20 of resin (FIG. 7B), and as the amount of bend increases, the amount of lateral overlap between the wings decreases (FIG. 7C) until the wings can finally move past one another (FIG. 7D). The wings are designed to withstand such hyper-elastic deflection without plastic deformation or tearing. Because of the longitudinal offset between the engaged wings ($O_{LB}$ in FIG. 5), the deflection is not all within a single plane but involves a certain amount of twist about a horizontal lateral axis. In this example, one of the projections 32 of each wing is caught in the recess 30 of the other wing (see FIG. 3) as the wings first contact one another during separation, and the separating wings do not fully overlap along their length, but only an amount equal to $L_W-O_{LB}$ (FIG. 5). The process of engaging two such fastener strips also involves significant wing deflection, but in the opposite direction as the wings deflect to pass by one another during engagement. It is desirable to have the force-deflection curve in the engagement direction be such that final engagement provides tactile or haptic feedback, such that the user feels (as well as perhaps hears) that the fastener strips have completely interlocked.

Figure 8:
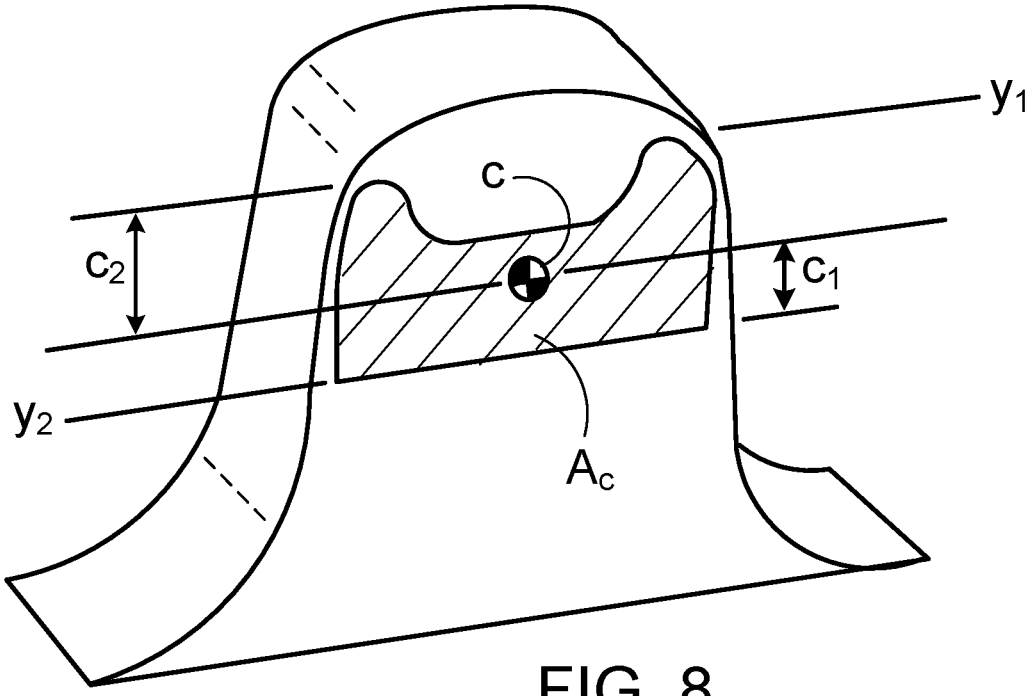
FIG. 8 is a cross-section view of a portion of another fastener element, through the interface between wing and stem.

There are particular physical properties that enhance the ability of the wings to undergo such significant deflection in both directions under applied loads, and to provide a desirable feedback. It has been found that one such property relates to the cross-sectional area of the wing in a vertical longitudinal plane. FIG. 8 shows such a cross-section at the interface between wing and stem (i.e., at the vertical surface of the stem), but of a fastener element with a stem in which the upper surface is convex rather than concave. The area $A_C$ of the cross-section has a centroid 'C' that is closer to the lower edge of the area than to the upper edge. In other words, C1<C2. Preferably, such a relationship holds not just at the interface with the stem, but in all vertical longitudinal planes through the wing, This property is believed to help promote a difference in the force/deflection curve for the wing as bent downward (during engagement) as compared to bent upward (during disengagement), resulting in a more perceptible haptic feedback of engagement while maintaining acceptable engagement/disengagement force values.

Figure 8A:
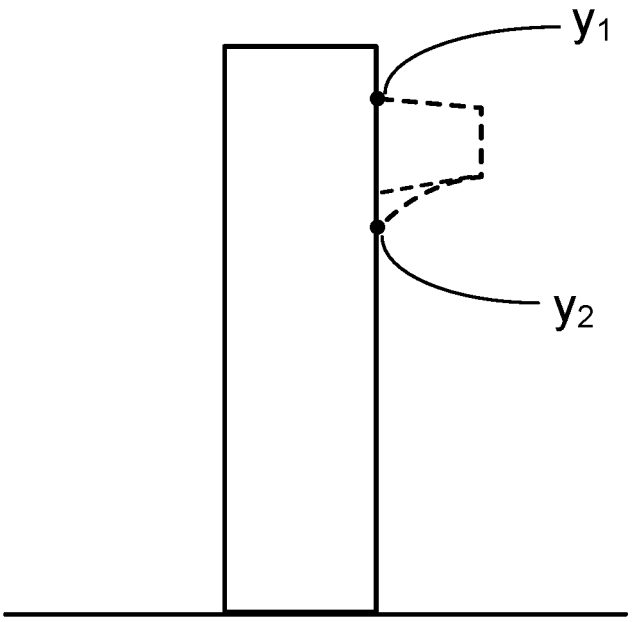
FIG. 8A is an end view of the fastener element of FIG. 8, showing one wing in dashed outline.

Referring also to FIG. 8A, the structure of the wing is also such that it has a greater statical moment of area with respect to bending downward about a horizontal bending axis ($Y_2$) along the lateral side surface of the stem at a lowermost extent of the wing, as compared to the statical moment of area with respect to bending upward about a horizontal bending axis ($Y_1$) along the lateral side surface of the stem at an uppermost extent of the wing.

In the fastener element wing shape shown in FIGS. 1-3, one can see that such a centroid positioning is in part the result of the recess in the top surface of the wing as compared with the bottom surface. Such centroid skewing does not depend on that particular shape. For example, each of the wing shapes shown in side view in FIGS. 9A-9F will have a centroid closer to the lower edge of the wing cross-section than to the upper edge. In each case, the cross-section does not vary across the lateral width of the wing (from stem to tip), other than due to mold release taper or a radius at the lower wing surface (illustrated by hatch marks in FIGS. 9A, 9B, 9D, 9E and 9F). The wing of FIG. 9C differs from that of FIG. 1 in the absence of any significant lower surface radius.

Figure 9A:
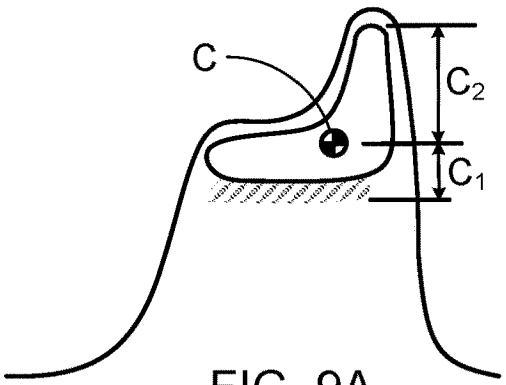
FIGS. 9A-9F show additional fastener element designs with different wing structures.
Figure 9B:
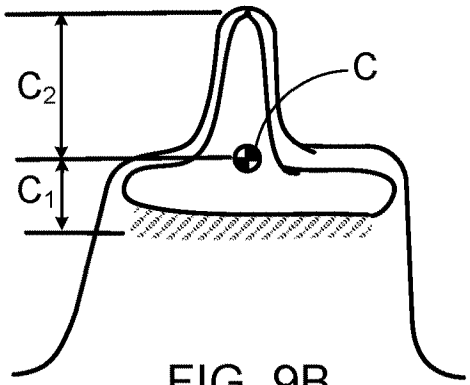
Figure 9C:
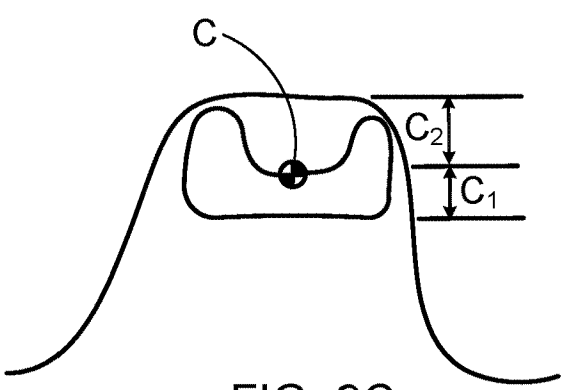
Figure 9D:
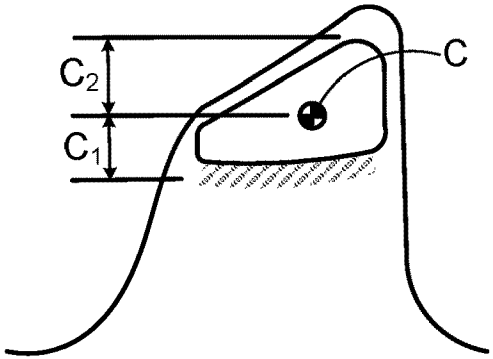
Figure 9E:
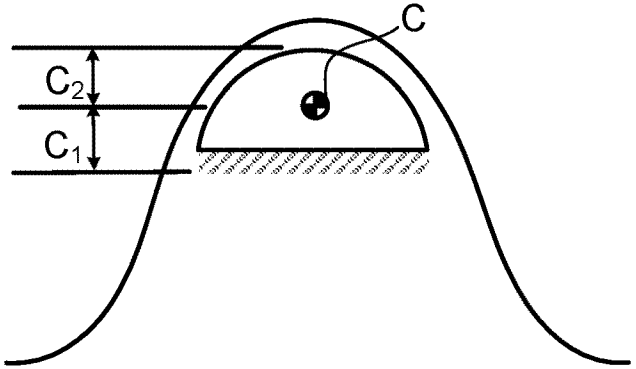
Figure 9F:
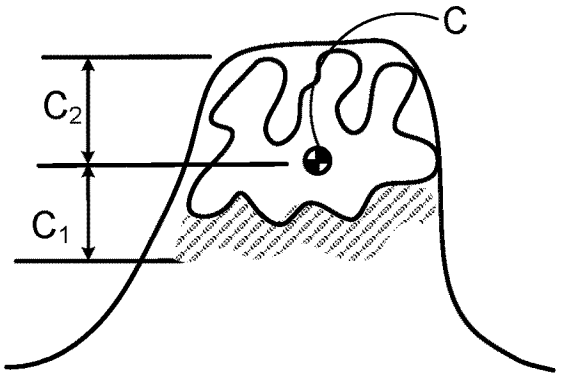

In the example of FIG. 9A, the upper surface of the wing features only one projection, positioned at one longitudinal end of the wing. The upper surface of the wing of FIG. 9B has one projection just slightly offset from the longitudinal center of the wing. The wing of FIG. 9C is like the one of FIG. 1 but without a lower radius. The wing of FIG. 9D has a wedge-shaped cross-section, with one longitudinal end thicker than the other, such that the upper surface is canted with respect to the strip surface. The wing of FIG. 9E is essentially in the form of a half-cylinder extending from the stem, with the curved portion facing away from the strip surface. In other words, within the vertical plane the upper side of the wing forms a circle and the underside of the wing forms a horizontal line. The wing of FIG. 9F is drawn to illustrate the general concept of the downward skew of the centroid in a cross-section that is rather complex with multiple upward projections and a non-planar underside.

Figure 10:
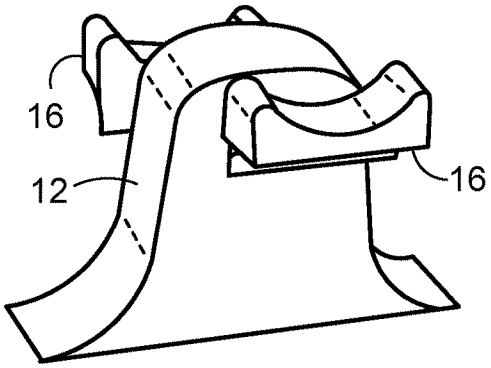
FIG. 10 is a perspective view of another fastener element, with offset wings.

As will be discussed below, the illustrated fastener element structures can be molded in cavities formed by aligning flat plates. Given this molding method, the wings may be readily offset from the centerline of the stem, to extend beyond the longitudinal ends of the stem. Such a structure is shown in FIG. 10, in which each wing extends longitudinally beyond the stem edge. The wings may each extend beyond a respective edge as shown, or they me both extend beyond the same edge (for example, in longitudinal alignment with each other). As long as the amount of longitudinal overhang is not too great, such a structure can function as a self-engaging fastener element to inter-engage with other such structures as discussed above. Such an overhang may also increase the utility of such a fastener element to releasably engage loop fibers, with the overhang forming a snag point for such fibers. This example also shows a convex upper stem surface like that of FIG. 8.

Figure 12:
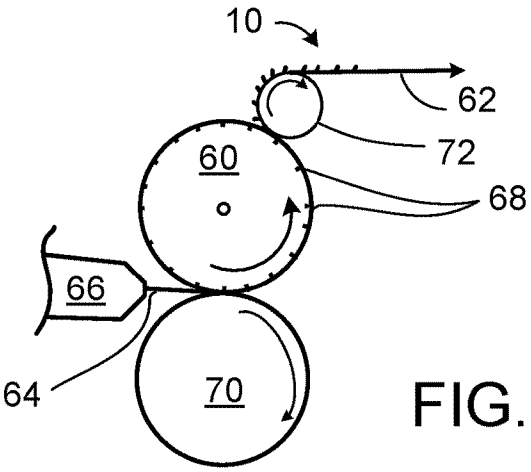
FIG. 12 schematically illustrates a method and apparatus for forming a fastener product.
Figure 11:
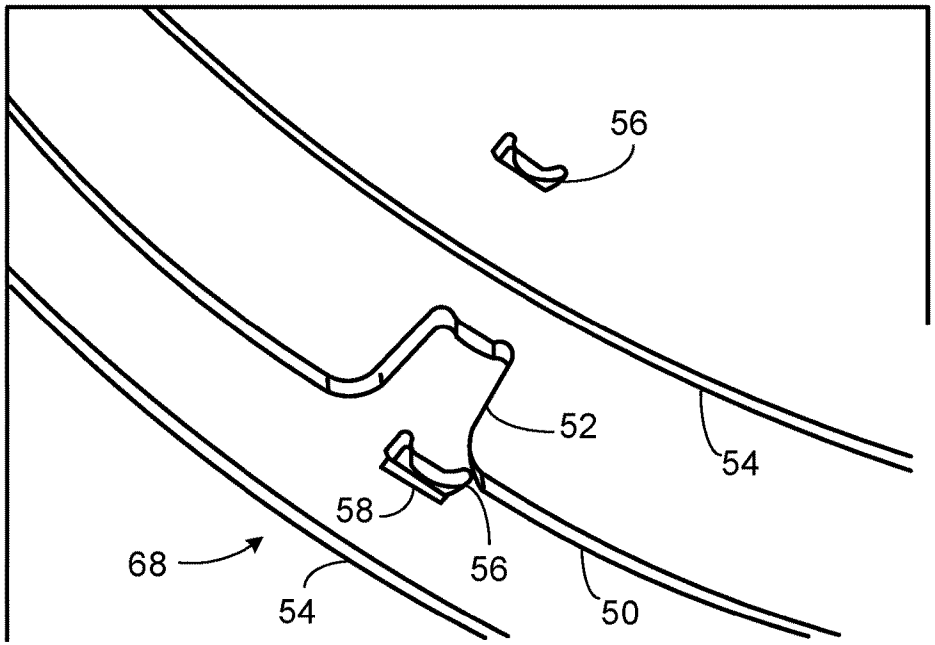
FIG. 11 is an enlarged, exploded view of a portion of an edge of a set of mold rings for molding the fastener element of FIGS. 1-3.

The fastener element structures described above can be molded to generally their desired shape in cavities extending radially inward from the outer cylindrical surface of a mold roll formed as a stack of concentric plates or rings. Each column of fastener elements is molded in a set of three rings including a stem ring sandwiched between two wing rings and spaced from adjacent sets of rings by solid or spacer rings against which the distal ends of the wings are formed. FIG. 11 shows a portion of a periphery of a set of three such rings. The stem ring 50 defines a stem-shaped cavity 52 open to the edge of the ring. Each wing ring 54 defines a wing-shaped cavity 56 positioned to be contiguous in the stacked set of rings with the stem-shaped cavity 52, such that when flowable resin is pressed into the stem-shaped cavity through the opening at the edge of the ring, it fills all three cavities. The surface of the adjacent spacer ring that is exposed to the wing-shaped cavity to form the distal end of the wing may be etched or contoured to form a non-flat distal wing end, if desired. The edges of the cavities at each ring side surface are sharp corners, other than at the outermost edge 58 of the wing-shaped cavities facing the stem ring 50, which is rounded to form the radius at the underside of the wing where it joins the stem. Each ring will have a large number of cavities spaced about its perimeter, such that the stacked set of rings may define upwards of 500 hook cavities. The rings of the set must be precisely rotationally aligned to ensure that the wing cavities overlap with the stem cavity. Referring also to FIG. 12, a mold roll 60 formed of several such ring sets stacked concentrically and held tightly together throughout the molding and extracting process can be employed to mold a continuous strip 62 of resin with an array of fastener elements 10 molded with its upper surface, as taught, for example, in U.S. Pat. No. 10,864,662, the entire contents of which as relate to methods of molding fastener elements are incorporated herein by reference. In this example, flowable resin 64 from an extruder 66 is pressed into the cavities 68 of the mold roll 60 by a counter-rotating pressure roll 70. Once solidified within the chilled mold roll, the molded fastener elements are stripped from their cavities by passing the resin layer formed on the surface of the mold roll about a stripper roll 72.

While a number of examples have been described for illustration purposes, the foregoing description is not intended to limit the scope of the invention, which is defined by the scope of the appended claims. There are and will be other examples and modifications within the scope of the following claims.

What is claimed is:

1. A fastener, comprising:

a flexible strip comprising a layer of resin and having opposite edges extending longitudinally along the flexible strip; and an array of discrete fastening elements carried on a surface of the flexible strip, each fastening element comprising a resin stem extending upward from, and contiguous with, the layer of resin, the stem having opposite lateral side surfaces facing the edges of the flexible strip; and a wing protruding from one of the lateral side surfaces of the stem and spaced above the layer of resin, the wing having an underside surface facing and overhanging the layer of resin, and an upper surface facing away from the layer of resin, the wing defining an area in a vertical plane coincident with one of the side surfaces of the stem, the area having a lowermost point and an uppermost point with respect to perpendicular distance from the layer of resin, the area defining a centroid, wherein as measured perpendicular to the layer of resin, the centroid is closer to the lowermost point than to the uppermost point.

2. The fastener of claim 1, wherein the upper surface forms a pair of projections spaced apart along the lateral side surface of the stem and extending away from the flexible strip, the upper surface defining a recess between the projections.

3. The fastener of claim 2, wherein the projections are disposed at opposite ends of the wing.

4. The fastener of claim 1, wherein in all vertical planes parallel to the side surface of the stem and extending through the wing, a cross-section of the wing has a centroid closer to a lowermost point of the cross-section than to an uppermost point of the cross-section.

5. The fastener of claim 1, wherein the wing extends laterally from the stem to a free distal edge.

6. The fastener of claim 1, wherein the underside surface of the wing is not reentrant.

7. The fastener of claim 1, wherein the upper surface of the wing is U-shaped.

8. The fastener of claim 1, wherein the wing has a thickness, measured perpendicular to the surface of the layer of resin, that is less at a point between opposite ends of the wing than at the opposite ends of the wing.

9. The fastener of claim 1, wherein the wing defines, adjacent the vertical plane, a greater statical moment of area with respect to bending downward about a first bending axis extending parallel to the layer of resin in the vertical plane at a lowermost extent of the wing, than with respect to bending upward about a second bending axis extending parallel to the layer of resin in the vertical plane at an uppermost extent of the wing.

10. The fastener of claim 1, wherein the array of discrete fastening elements is configured and arranged to form a releasable fastening when inter-engaged with an identical array.

11. The fastener of claim 10, wherein the array of discrete fastening elements is configured and arranged to cause each fastener element of a column disposed between fastener element columns of the identical array to overlap wings of at least three fastener elements of the identical array.

12. A method of releasably joining two surfaces, the method comprising:

bringing two fasteners of claim 1 into contact with each other such that the wings of one of the fasteners are in contact with the wings of the other of the fasteners, with each of the two fasteners carried on respective ones of the two surfaces; and pressing the two fasteners together such that the wings deflect to interlock, leaving the wings of the one of the two fasteners closer to the layer of resin of the other of the two fasteners than the wings of the other of the two fasteners.

13. A method of molding a fastener product, the method comprising:

pressing flowable resin into a mold defining an array of closed fastener element cavities extending inward from a surface of the mold;

solidifying the pressed resin in the cavities along with a layer of resin formed on the surface of the mold; and stripping the solidified resin from the cavities by tension applied to the layer;

wherein each cavity is shaped to form:

a resin stem extending upward from, and contiguous with, the layer of resin, the stem having opposite lateral side surfaces facing the edges of the flexible strip; and a wing protruding from one of the lateral side surfaces of the stem and spaced from the layer of resin, the wing having an underside surface facing and overhanging the layer of resin, and an upper surface facing away from the layer of resin, the wing defining an area in a vertical plane coincident with one of the side surfaces of the stem, the area having a lowermost point and an uppermost point with respect to perpendicular distance from the layer of resin, the area defining a centroid, wherein as measured perpendicular to the layer of resin, the centroid is closer to the lowermost point than to the uppermost point.

* * * * *